US007000408B2

(12) United States Patent
Mitsubori

(10) Patent No.: US 7,000,408 B2
(45) Date of Patent: Feb. 21, 2006

(54) SUPERCONDUCTING MAGNET APPARATUS AND MAINTENANCE METHOD OF REFRIGERATOR FOR THE SAME

(75) Inventor: Hitoshi Mitsubori, Hiratsuka (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 155 days.

(21) Appl. No.: 10/758,021

(22) Filed: Jan. 16, 2004

(65) Prior Publication Data

US 2005/0166600 A1 Aug. 4, 2005

(30) Foreign Application Priority Data

Oct. 15, 2003 (JP) ..... 2003-355100

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 4,906,266 A * 3/1990 Planchard et al. ..... 62/6
5,111,665 A * 5/1992 Ackermann ..... 62/6
5,701,742 A * 12/1997 Eckels et al. ..... 62/6
5,737,927 A * 4/1998 Takahashi et al. ..... 62/51.1
5,966,944 A * 10/1999 Inoue et al. ..... 62/51.1
6,438,967 B1 * 8/2002 Sarwinski et al. ..... 62/6

FOREIGN PATENT DOCUMENTS

JP 60-187007 A1 9/1985
JP 63-236707 A1 10/1988
JP 01-149406 A1 6/1989
JP 2001-230459 A1 8/2001

* cited by examiner

*Primary Examiner*—William C. Doerrler
(74) *Attorney, Agent, or Firm*—Rader, Fishman & Grauer PLLC

(57) ABSTRACT

A superconducting magnet apparatus includes superconducting coils in a vacuum vessel. The vacuum vessel is provided with a refrigerator for cooling the superconducting coils. The refrigerator includes a motor drive, displacers, and a cooling cylinder accommodating the displacers such that the displacers may reciprocate therein. The vacuum vessel has a sleeve for accommodating the cooling cylinder while isolating them from its vacuum area, the sleeve having an opening near the wall of the vacuum vessel. A first flange is provided at an opening in the cooling cylinder for inserting the displacers therein. The motor drive is attached to the first flange, with the displacers being inserted therein. The first flange has a cylindrical portion to be inserted in the sleeve to seal the space in the sleeve. The motor drive and the displacers can be removed, while leaving the first flange and the cooling cylinder unremoved.

10 Claims, 13 Drawing Sheets

SUPERCONDUCTING MAGNET APPARATUS AND MAINTENANCE METHOD OF REFRIGERATOR FOR THE SAME

This application claims priority to prior application JP2003-355100, the disclosure of which is incorporated herein by reference.

BACKGROUND OF THE INVENTION

1. Field of the Invention

The present invention relates to a superconducting magnet apparatus combined with a cryostat cooled by a refrigerator, and a maintenance method of the refrigerator used for the superconducting magnet apparatus. The present invention relates particularly to a superconducting magnet apparatus suited for a single crystal pulling device and a maintenance method for a refrigerator used for the superconducting magnet apparatus.

2. Description of the Related Art

Recently, a Gifford-McMahon ("GM") refrigerator R, as shown in FIG. 1, is being used as a cooling device for a cryostat (cryogenic vacuum vessel or chamber) in replace of liquid helium. The GM refrigerator R primarily includes a motor drive M, a plurality of stages (two in this example) of cooling cylinders C1, C2, and displacers D1, D2 that include heat reservoirs and are driven by the motor drive M to reciprocate in the cylinders C1, C2.

A first-stage cold head H1 is provided at the lower end of the first-stage cooling cylinder C1, and a second-stage cold head H2 is provided at the lower end of the second-stage cooling cylinder C2. An upper opening rim portion of the first-stage cooling cylinder C1 has a flange 4 for mounting the motor drive M and for installation to a vacuum vessel or chamber, which will be discussed hereinafter. The displacers D1, D2 are inserted into the first and second-stage cooling cylinders C1, C2 through an opening in the flange 4.

The GM refrigerator R having the first and second-stage cold heads H1, H2 enables the first-stage cold head H1 to be set to cryogenic levels ranging from 70K to 40K, and the second-stage cold head H2 to be set from 20K to 4K. The cold heads of these stages cool an object to a desired temperature. Such a GM refrigerator has been disclosed in, for example, Japanese Unexamined Patent Application Publication No. 2001-230459.

As a silicon single crystal manufacturing apparatus, a single crystal pulling device based on the Czochralski process (CZ process) has been used for fusing polycrystalline silicon to grow a single-crystal seed crystal. In the single crystal pulling device, silicon is fused in a crucible, generating thermal convection. This leads to deteriorated quality in generated single crystal in some cases. A method is known for restraining such convection by applying a magnetic field to the fused silicon so as to effect electromagnetic braking primarily to improve the quality of the generated single crystal. This method is called the magnetic Czochralski process (MCZ process). It has been known that a perpendicular magnetic field in a direction perpendicular to the liquid level of fused silicon, a horizontal magnetic field in a direction parallel to the liquid level of fused silicon, or a cusp magnetic field is applied to the fused silicon. Furthermore, a superconducting magnet apparatus having a GM refrigerator is used as a magnetic field applying device. This type of superconducting magnet apparatus normally includes multiple GM refrigerators.

Maintenance of the GM refrigerator R is required whenever the GM refrigerator R is used for a long time (about 10,000-hour operation) for cooling the superconducting magnet apparatus used with the single crystal pulling device. Normal maintenance includes replacement and inspection of parts constantly in motion. Performing the maintenance operation requires the motor drive M and the displacers D1, D2 connected thereto be pulled out and removed from the first and second-stage cooling cylinders C1, C2.

If, however, the displacers D1, D2 cooled to a low temperature should be pulled out of the first and second-stage cooling cylinders C1, C2 in the atmosphere without interrupting the operation of the superconducting magnet apparatus, then moisture in the air will instantly turn into a frozen film and adhere to the inner surfaces of the first and second-stage cooling cylinders C1, C2. The adhering frozen film can be temporarily removed by a dryer or the like. However, the first and second-stage cooling cylinders C1, C2 continue to be cooled in a cryogenic vacuum vessel. This causes the frozen film to be produced on the inner surfaces of the first and second-stage cooling cylinders C1, C2 again, thus preventing the maintenance operation from being performed.

Therefore, the operation of not only the single crystal pulling device but the superconducting magnet apparatus also had to be interrupted to increase the entire superconducting magnet apparatus to normal temperature (or room temperature) before starting a maintenance operation. For the superconducting magnet apparatus to be increased from 4K to the normal temperature after the operation of the superconducting magnet apparatus is stopped, it requires about 6 days to about 20 days although it depends on the sizes of coils thereof. Then, one day is spent to carry out maintenance on multiple GM refrigerators installed in the superconducting magnet apparatus. Thereafter, the operation of the superconducting magnet device is restarted to cool the coils, taking as the same number of days as that spent for increasing the temperature of the coils. The operation of the single crystal pulling device is not resumed until the coil temperature reaches 4K. Thus, the maintenance of the GM refrigerators takes a total of two weeks to almost one month and a half. The operation of the single crystal pulling device is suspended, resulting in a considerable operation loss.

As a possible solution to the aforementioned problem, the whole set of the GM refrigerators including the first and second-stage cooling cylinders C1, C2 may be replaced with another set that has already been maintained, rather than changing parts of the GM refrigerators requiring maintenance. FIG. 2 shows a proposed structure based on this design concept.

Referring to FIG. 2, a top plate 111 of a vacuum vessel 100 has a sleeve 2 with an opening in its top to provide isolation from a vacuum area in the vacuum vessel 100. The first and second-stage cooling cylinders C1 and C2, respectively, of the GM refrigerator R are inserted through the upper opening of the sleeve 2. This installs the GM refrigerator R such that the first and second-stage cooling cylinders C1, C2 are isolated from the vacuum area in the vacuum vessel 100.

The sleeve 2 has a first-stage sleeve 2*a* and a second-stage sleeve 2*b*. A lower end of the first-stage sleeve 2*a* has a first-stage cooling flange F1. The second-stage sleeve 2*b* has its upper end connected to the first-stage cooling flange F1, and has a second-stage cooling flange F2 provided at its lower end. The first-stage sleeve 2*a* has a flange F3 welded to the rim of its opening to air-tightly bolt it to the top plate 111 of the vacuum vessel 100. As previously mentioned, the flange 4 is also bolted to the top plate 111 of the vacuum vessel 100. The top plate portion of a heat shield vessel 106 is installed to the first-stage cooling flange F1 in such a manner to permit heat transmission. An object to be cooled, such as the superconducting magnet apparatus, is in contact with the second-stage cooling flange F2 so as to permit heat transmission.

Referring to FIG. 2, indium sheets 3*a* and 3*b* having a thickness of about 0.5 mm to about 1 mm are placed between the contact surfaces of the first-stage cold head H1 and the first-stage cooling flange F1 and between the contact surfaces of the second-stage cold head H2 and the second-stage cooling flange F2 in the GM refrigerator R to enhance thermal contact of these contact surfaces. The indium sheet 3*a* has a ring shape while the indium sheet 3*b* has a circular shape. Hereinafter, the contact surfaces will be referred to as the "thermal contact interfaces."

In FIG. 2, the sleeve 2 is drawn using a single line, ignoring its wall thickness. A gap exists between the inner surface of the sleeve 2 and the outer surfaces of the first and second-stage cooling cylinders C1 and C2, the thermal contact interfaces being excluded. The thermal contact interfaces are orthogonal with respect to the direction in which the first and second-stage cooling cylinders C1 and C2 extend.

Using the sleeve 2 described above makes it possible to replace the whole set of the GM refrigerator without the need for increasing the superconducting magnet apparatus to the normal temperature. The aforementioned proposed structure, however, poses a problem when the new GM refrigerator is installed. More specifically, whenever the whole set of the GM refrigerator including the first and second-stage cooling cylinders C1 and C2 is pulled out from the sleeve 2 to replace it, the GM refrigerator assembly is unavoidably exposed. This causes air to get into the sleeve 2 of a cryogenic temperature. As a result, a frozen film formed by moisture or the like in the air adheres to the thermal contact interfaces of the cold heads and the sleeve 2 of the new GM refrigerator to be inserted. This leads to deteriorated thermal contact performance or heat transmitting performance.

The maintenance method using the above sleeve 2 presents the following disadvantages.

(1) A shielding unit is required to prevent air from getting into the sleeve when replacing the GM refrigerators.

(2) The GM refrigerators must be replaced in the shielding unit.

(3) The indium sheets between the thermal contact interfaces are rapidly cooled and hardened, causing them to lose their flexibility when they are in contact with the cold heads.

(4) When the GM refrigerators are replaced, if the first and second-stage cooling cylinders C1 and C2, respectively, of the GM refrigerators are inserted and fixed aslant, the contact area of the thermal contact interfaces is undesirably reduced.

(5) If a replacement failure happens, the maintenance method cannot be redone.

(6) The replacement work includes many steps, requiring skill to successfully perform it.

SUMMARY OF THE INVENTION

Accordingly, it is an object of the present invention to permit easy maintenance of a refrigerator, which is incorporated in a superconducting magnet apparatus, without the need for any shielding unit and while keeping the superconducting magnet apparatus in a cryogenic state.

The present invention applies to a superconducting magnet apparatus having a vacuum vessel, a superconducting coil accommodated in the vacuum vessel, and one or more refrigerators attached to the vacuum vessel to cool the superconducting coil.

According to one aspect of the present invention, a refrigerator includes a motor drive, a displacer attached to the motor drive and driven by the motor drive, and a cooling cylinder accommodating the displacer so as to allow the displacer to reciprocate. A vacuum vessel is formed of a double-cylindrical structure having a hollow space in its center. The vacuum vessel has a sleeve for accommodating the cooling cylinder by isolating it from a vacuum area in the vacuum vessel. The sleeve has an opening near the wall of the vacuum vessel. The cooling cylinder is partly in surface contact with the sleeve. The opening portion of the cooling cylinder through which the displacer is inserted has a first flange to which the motor drive is installed with the displacer inserted therein and also has a cylindrical portion inserted into the sleeve to seal the space in the sleeve. A sealing ring is provided between the cylindrical portion and the inner wall of the sleeve that opposes the cylindrical portion. The displacer can be replaced with a new displacer by removing the motor drive and the old displacer, while the first flange and the cooling cylinder remain unremoved.

Preferably, the superconducting magnet apparatus in accordance with the present invention is constructed as described below. Near the opening of the sleeve, a second flange opposing the first flange is provided integrally with the vacuum vessel such that it slightly juts out of the vacuum vessel. The first flange and the second flange are fastened together with a plurality of first bolts, at least one guide pin being provided therebetween. The guide pin is used to restrict the inclination of the cooling cylinder tilted by the displacer when the cylindrical portion is inserted into the sleeve.

A single crystal pulling device may be housed in the hollow space of the vacuum vessel to provide a superconducting magnet apparatus for the single crystal pulling device.

Another aspect of the present invention provides a maintenance method for a refrigerator in the foregoing superconducting magnet apparatus. To implement the maintenance method, the following construction is adopted.

The cooling cylinder may be partly in surface contact with the sleeve on the surface orthogonal with respect to the direction in which the cooling cylinder extends. To replace the displacer, a predetermined number of the plural first bolts may be removed, and the remaining first bolts may be loosened. The second bolts may be screwed from the first flange side into the portions from which the first bolts have been removed. Then, the first flange may be pulled apart from the second flange to draw out the cylindrical portion by about a few millimeters so as to clear the surface contact while maintaining the sealing between the sleeve and the cooling cylinder. The second bolts and the motor drive may be removed from the first flange to draw out the displacer from the cooling cylinder. The temperature in the cooling cylinder may be increased, and then a new assembly of the motor drive and the displacer may be inserted into the cooling cylinder through the first flange. Subsequently, a pressing force may be applied to the head of the motor drive by a booster to set the cylindrical portion back to its original position to bring the cooling cylinder partly into surface contact with the sleeve. Lastly, the first bolts may be tightened.

The arrangements described above provide the following major advantages.

1) Performance hardly deteriorates after replacing a refrigerator during maintenance, and redo is possible even if a replacement error is found.

2) A replacement operation can be accomplished in a shorter time with great ease.

3) Maintenance cost is lower.

4) An operation loss of a single crystal pulling device caused by a maintenance operation can be minimized.

BRIEF DESCRIPTION OF THE DRAWINGS

FIGS. 9A and 9B are diagrams for explaining operations necessary to detach a motor drive and a displacer, wherein FIG. 9A is a top view of a first flange, and FIG. 9B is an enlarged view of a part of the first flange and its neighborhood;

FIGS. 13A and 13B are diagrams illustrating a construction of a booster used for performing the operation illustrated in FIG. 12, wherein FIG. 13A is an exploded view of the booster, and FIG. 13B shows a hydraulic jack and a jig used with the hydraulic jack.

DESCRIPTION OF THE PREFERRED EMBODIMENTS

Figure 3:
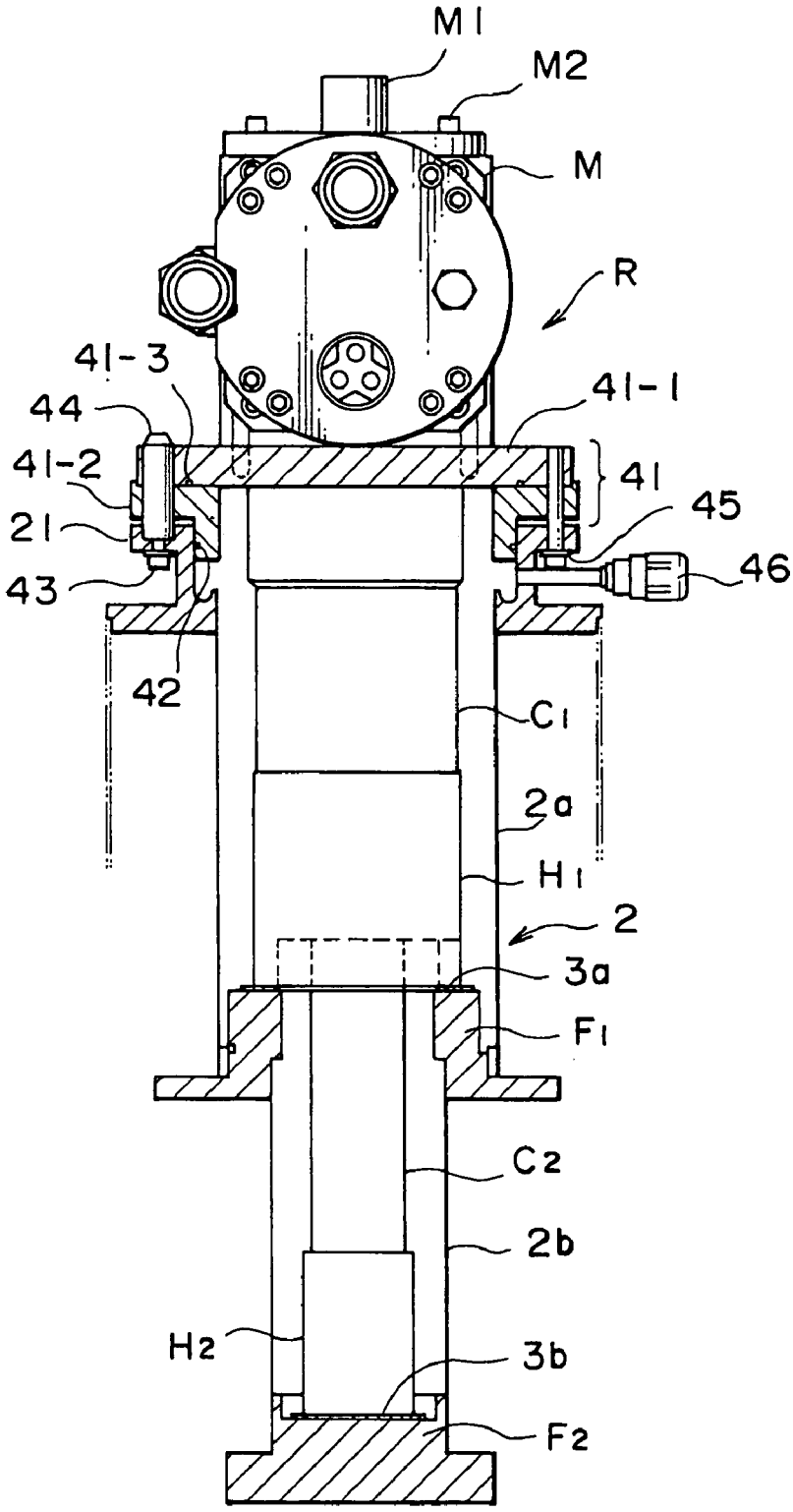
FIG. 3 is a structural diagram showing a GM refrigerator to which the present invention is applied.

Referring first to FIG. 3, a construction for installing a refrigerator to be maintained in accordance with the present invention will be described. The following description will be given of a case where the present invention is applied to a GM refrigerator.

Figure 1:
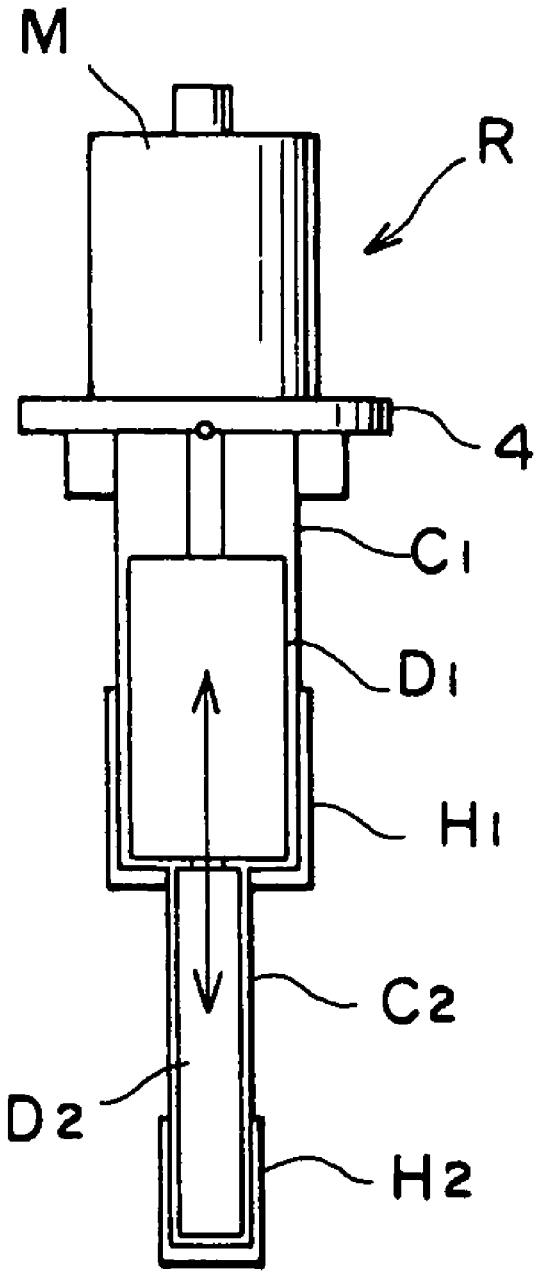
FIG. 1 PRIOR ART
FIG. 1 is a block diagram showing the construction of a conventional GM refrigerator.
Figure 2:
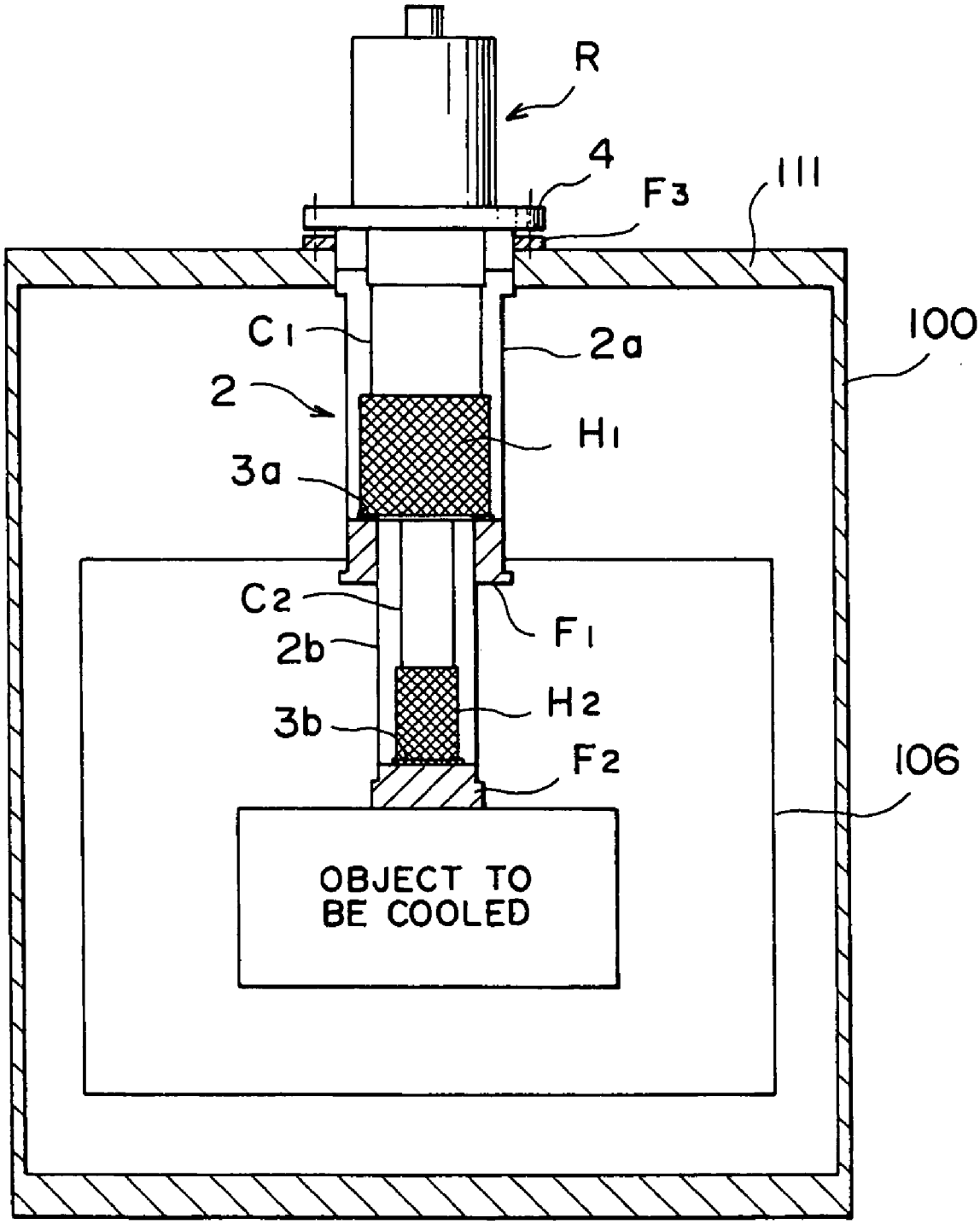
FIG. 2 is a diagram showing a proposed construction for installing the GM refrigerator shown in FIG. 1 to a vacuum vessel.

The installing construction is characterized by a flange 21 (a second flange) at the upper opening of a sleeve 2, a flange 41 (a first flange) provided on an upper opening rim of a first-stage cooling cylinder C1 located at a position corresponding to the flange 21, and a structure surrounding these flanges. The construction of the remaining portion is substantially identical to those shown in FIGS. 1 and 2, so that like reference numerals are assigned to like components. The sleeve 2 is made integral with a vacuum vessel to be discussed hereinafter. In other words, the sleeve 2 may include the flange 21 and may be fixedly attached to the vacuum vessel by welding or the like, or the sleeve may be fixedly secured by welding or the like to the flange 21 provided on the vacuum vessel. The following will describe the former case.

A GM refrigerator R is inserted in a vacuum vessel accommodating a superconducting magnet apparatus, which will be discussed hereinafter, to cool superconducting coils. As previously described, the GM refrigerator R includes a motor drive M, displacers attached to the motor drive M and driven by the motor drive M, and a cooling cylinder accommodating the displacers such that the displacers can reciprocate therein. The displacers, which are not shown in FIG. 3, are the same as those shown in FIG. 1. The cooling cylinder in this example has first and second-stage cooling cylinders C1 and C2.

A first-stage cold head H1 is provided at the lower end of the first-stage cooling cylinder C1, and a second-stage cold head H2 is provided at the lower end of the second-stage cooling cylinder C2. An upper opening rim portion of the first-stage cooling cylinder C1 has a flange 41 for mounting the motor drive M and for installation to a vacuum vessel. More specifically, the flange 41 is attached to the vacuum vessel through the intermediary of the flange 21. The displacers are inserted into the first and second-stage cooling cylinders C1, C2 through an opening in the flange 41.

The sleeve 2 has a first-stage sleeve 2*a* and a second-stage sleeve 2*b*. The lower end of the first-stage sleeve 2*a* has a first-stage cooling flange F1. The upper end of the second-stage sleeve 2*b* is connected to the first-stage cooling flange F1, while the lower end thereof has a second-stage cooling flange F2. The upper opening rim of the first-stage sleeve 2*a* is provided with the flange 21 for installation to the vacuum vessel. A flange-shaped portion similar to the flange 21 is provided slightly below the flange 21. The flange-shaped portion constitutes a part of the wall of the vacuum vessel, which will be discussed hereinafter. In other words, the flange 21 is provides such that it slightly juts out of the outer wall of the vacuum vessel, the reason for which will be explained later.

In this example also, indium sheets 3*a* and 3*b* having a thickness of about 0.5 mm to about 1 mm are provided on the thermal contact interfaces between the first-stage cold head H1 and the first-stage cooling flange F1 and between the thermal contact interfaces of the second-stage cold head H2 and the second-stage cooling flange F2 in the GM refrigerator R to enhance thermal contact of these contact surfaces.

This GM refrigerator R allows the first-stage cold head H1 to reach cryogenic temperatures ranging from 70K to 40K and the second-stage cold head H2 to reach cryogenic temperatures ranging from 20K to 4K. These stages of cold heads cool an object to a desired temperature. As in the same manner explained in conjunction with FIG. 2, the top plate of a heat radiation shielding member (to be described later) disposed in the vacuum vessel is installed to the first-stage cooling flange F1 such that heat can be transferred. The superconducting coils of the superconducting magnet apparatus are attached to the second-stage cooling flange F2 such that heat can be transferred.

In FIG. 3 also, the sleeve 2 is drawn using a single line, ignoring its wall thickness. A gap exists between the inner surface of the sleeve 2 and the outer surfaces of the first and second-stage cooling cylinders C1 and C2, the thermal contact interfaces being excluded. The thermal contact interfaces are orthogonal with respect to the direction in which the first and second-stage cooling cylinders C1 and C2 extend.

The flange 41 is provided at a location matching the location of the flange 21 of the sleeve 2, namely, at the upper opening rim of the first-stage cooling cylinder C1. The flange 41 has an annular board member 41-1 and a cylindrical portion 41-2. The board member 41-1 is for mounting the motor drive M with the displacers inserted therein. The cylindrical portion 41-2 is inserted in the upper portion of the sleeve 2 to seal the space inside the sleeve 2 in cooperation with the board member 41-1 with the motor drive M attached thereto. The board member 41-1 and the cylindrical portion 41-2 are combined into one piece by bolts (not shown), a sealing O-ring (sealing ring) 41-3 being provided at the junction therebetween. Thus, the first and second-stage cooling cylinders C1 and C2 are housed in the sleeve 2, being isolated from the vacuum area in the vacuum vessel.

A rubber O-ring (sealing ring) 42 seals the gap between the cylindrical portion 41-2 and the inner wall of the sleeve 2 that opposes the cylindrical portion 41-2. The rubber O-ring 42 prevents a sealing failure caused by a small gap between the inner surface of the sleeve 2 and the outer surface of the cylindrical portion 41-2. The gap is formed, because the cylindrical portion 41-2 is vertically movable with respect to the sleeve 2, as will be discussed hereinafter.

The flange 41 and the flange 21 are fastened together by a plurality of bolts 43 (first bolts) provided at equiangular intervals. The bolts are tightened from under the flange 21, but loosely inserted in the flange 21 for the reason described below. At least one guide pin 44 is provided between the flange 41 and the flange 21. In this example, four guide pins 44 are provided at equiangular intervals of 90 degrees. The guide pins 44 function to restrain the first and second-stage cooling cylinders C1 and C2 from being inclined by the displacers when the cylindrical portion 41-2 is fitted onto the sleeve 2. The guide pins 44 are vertically provided on the flange 21, and the cylindrical portion 41-2 and the board member 41-1 have through holes for the guide pins 44.

Furthermore, a spring washer 45 is placed between the heads of all or some of the plural bolts 43 and the flange 21 opposing the heads. The spring washer 45 generates an urging force for pulling the flange 41 downwards in the figure through the intermediary of the bolts 43. More specifically, when the initial cooling is begun and the first-stage cooling cylinder C1 is cooled, the first-stage cooling cylinder C1 contracts. This causes the first-stage cold head H1 to attempt to leave the first-stage cooling flange F1. However, the spring washer 45 pushes the first-stage cooling cylinder C1 down so as to maintain the surface contact between the first-stage cold head H1 and the first-stage cooling flange F1. A pressure reducing apparatus, such as a vacuum pump, is connected to a connector 46 to vacuumize the space between the sleeve 2 and the first and second-stage cooling cylinders C1 and C2. When the GM refrigerator R is first attached to the vacuum vessel, the pressure reducing apparatus is connected to the connector 46 to vacuumize the space between the sleeve 2 and the first and second-stage cooling cylinders C1 and C2.

Figure 4A:
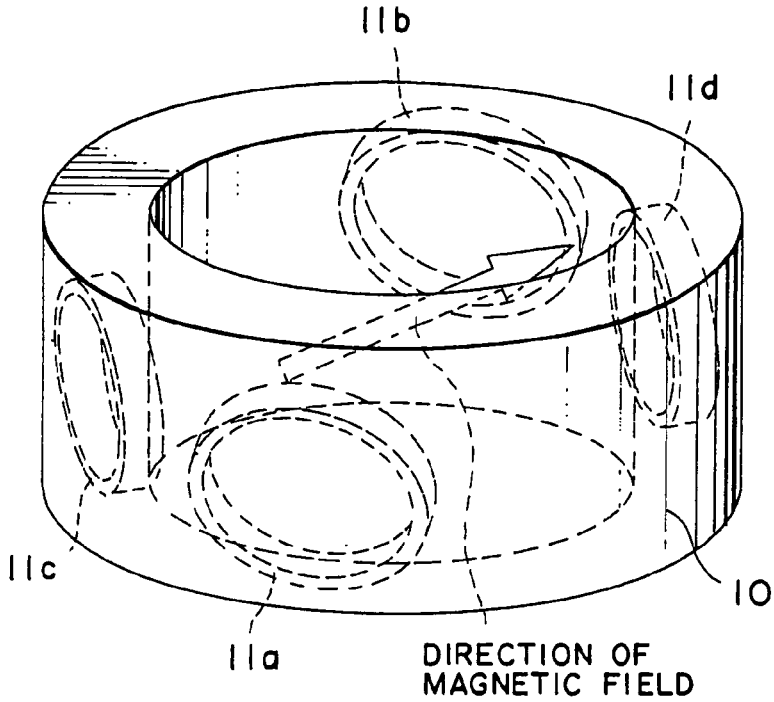
FIGS. 4A and 4B are diagrams illustrating a layout example of superconducting coils in a superconducting magnet apparatus according to the present invention.
Figure 4B:
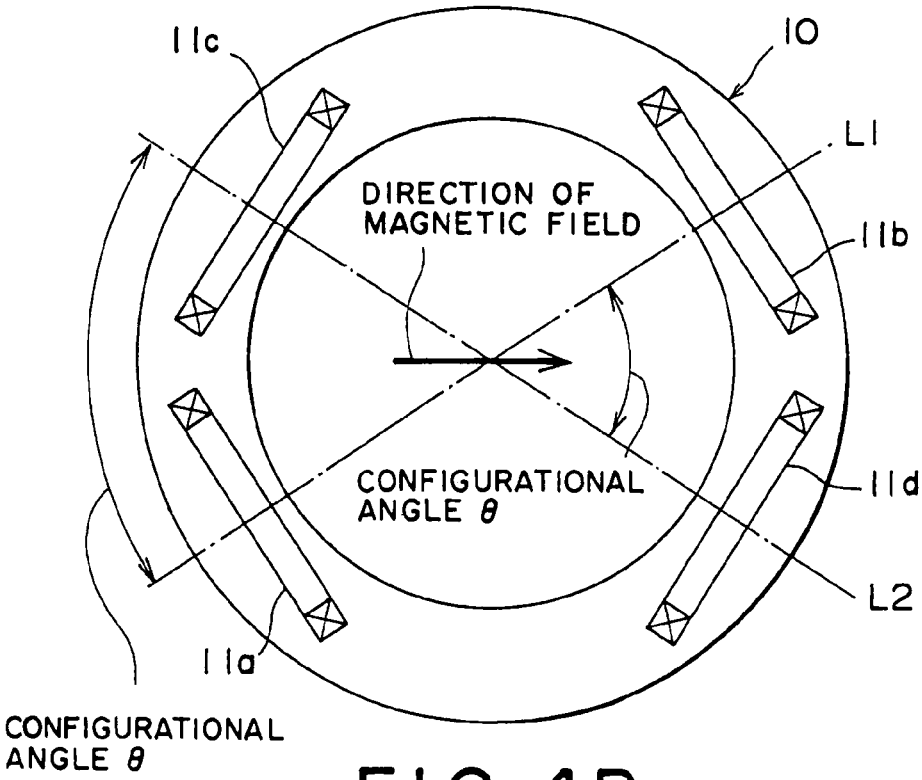

Referring now to FIGS. 4A and 4B, a superconducting magnet apparatus cooled by a refrigerator in accordance with the present invention will be outlined. The superconducting magnet apparatus shown in FIG. 4A has a double-cylinder vacuum vessel 10 having a hollow space (atmospheric space) in its central portion, two pairs of solenoid superconducting coils 11*a* through 11*d* that are vertically disposed in the vacuum vessel 10 and generate horizontal magnetic fields, and a GM refrigerator (not shown) for cooling the superconducting coils.

In this example, the two pairs of superconducting coils 11*a* through 11*d* are fixedly disposed, as illustrated in FIG. 4B. One pair of superconducting coils 11*a*, 11*b* and the other pair of superconducting coils 11*c*, 11*d* are arranged such that the two coils of each pair oppose each other with the hollow space therebetween. In addition, these two pairs of superconducting coils 1*a* through 11*d* are adjacently disposed such that a segment L1 connecting the centers of the superconducting coils 11*a* and 11*b* of one pair and a segment L2 connecting the centers of the superconducting coils 11*c* and 11*d* of the other pair form a configurational angle θ defined by $40° \leqq \theta \leqq 90°$. This superconducting magnet apparatus is used with, for example, a single crystal pulling device based on the MCZ process.

Figure 5:
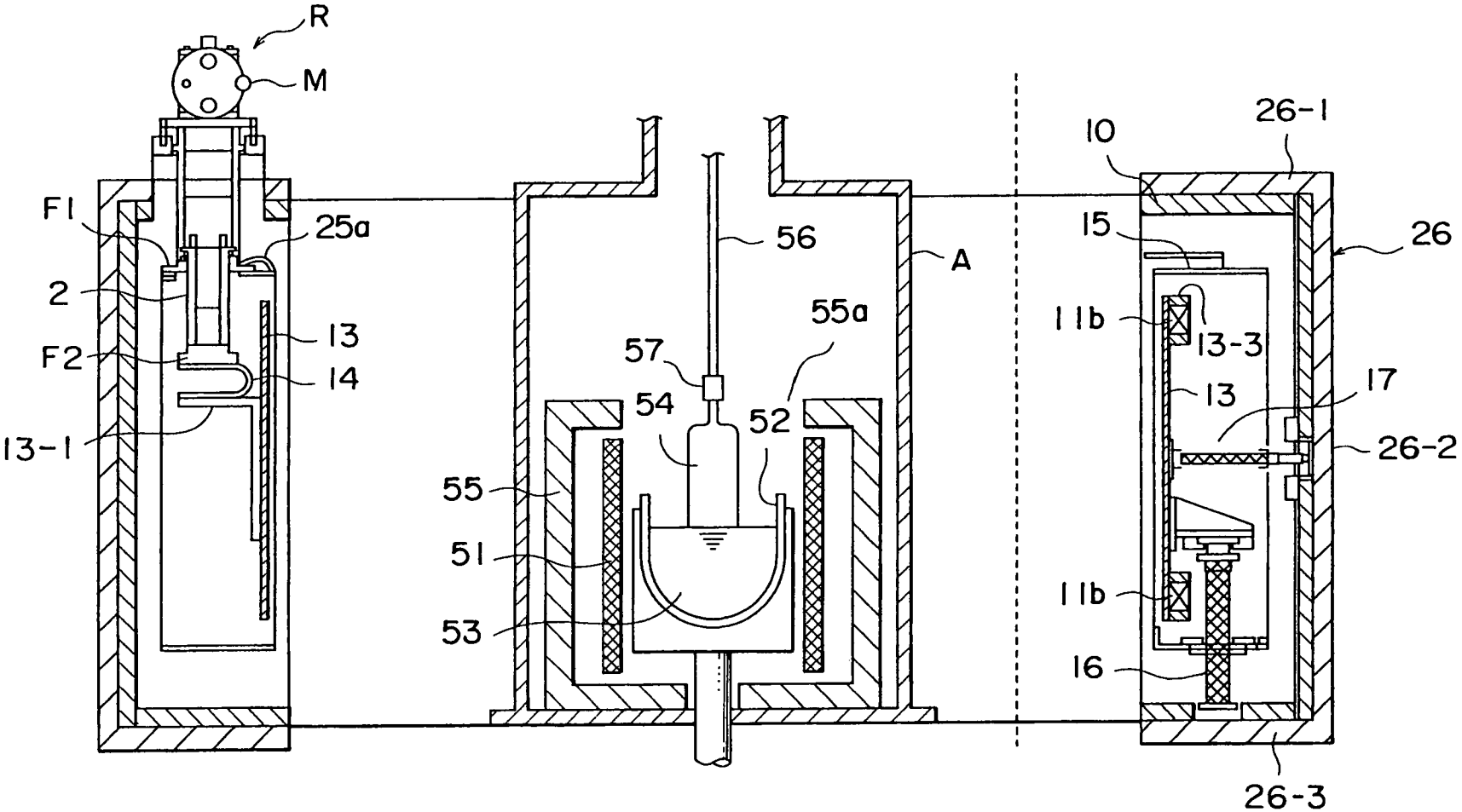
FIG. 5 is a sectional diagram showing a configuration example of the superconducting magnet apparatus according to the present invention in combination with a single crystal pulling device.

Referring now to FIG. 5, the vacuum vessel 10 has a double-cylinder structure capable of surrounding a single crystal pulling device. The single crystal pulling device is disposed in the hollow space formed inside the vacuum vessel 10. The vacuum vessel 10 is usually provided with two or more GM refrigerators R, although only one GM refrigerator R is shown in FIG. 5. In this example, the GM refrigerator R can be inserted from above the vacuum vessel 10, while it may alternatively be inserted from the bottom side in other cases. The foregoing two pairs of superconducting coils 11*a* through 11*d* (only 11 b being shown) apply a horizontal magnetic field to fused silicon in a crucible of the single crystal pulling device.

The two pairs of superconducting coils 11*a* through 11*d* and a structure 13 supporting them are housed, together with the bottom portion of the sleeve 2, in a double-cylinder heat radiation shielding member 15 disposed in the vacuum vessel 10. The heat radiation shielding member 15 prevents radiation heat from coming in. The sleeve 2 extends downwards, passing through the top of the heat radiation shielding member 15. The first-stage cooling flange F1 of the sleeve 2 and the heat radiation shielding member 15 are connected using a flexible heat transfer member 25*a* made of mesh wires or a multi-layer plate to prevent stress from being produced due to thermal shrinkage between the heat radiation shielding member 15 and the sleeve 2. The superconducting coils 11*a* through 11*d*, the structure 13, and the heat radiation shielding member 15 are supported by a plurality of vertical load supporting members 16 provided on the inner bottom of the vacuum vessel 10.

The side wall of the vacuum vessel 10 has a plurality of horizontal load supporting members 17 that passes through the side wall in a sealed manner and passes through the heat radiation shielding member 15, and is connected to the structure 13. A magnetic shielding member 26 is provided around the vacuum vessel 10 to allow leakage of surrounding magnetic fields to be reduced. The magnetic shielding member 26 is constructed of an upper surface magnetic shielding member 26-1, a side surface magnetic shielding member 26-2, and a lower surface magnetic shielding member 26-3.

The second-stage cooling flange F2 of the sleeve 2 is positioned near a connection portion 13-1 provided on the structure 13. The second-stage cooling flange F2 and the connection portion 13-1 are joined using a flexible multi-layer plate heat transfer member 14. This arrangement restrains the generation of stress caused by thermal contraction between the coil fixing structure 13 and the sleeve 2.

In the meanwhile, FIGS. 4A and 4B illustrate an example of coil layout for generating horizontal magnetic fields. In this case, as shown in FIG. 4B, the directions of resultant magnetic fields of the two pairs of superconducting coils are substantially the same, and a magnetic field crosses the center of the superconducting magnet apparatus, that is, the center of the hollow space of the vacuum vessel.

Figure 6A:
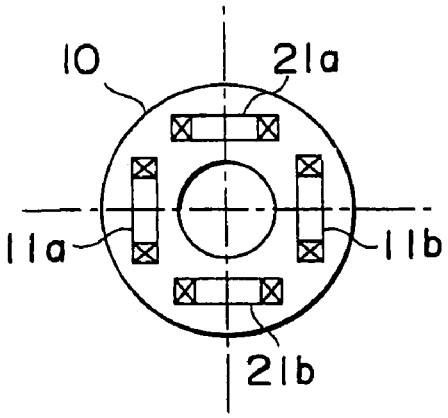
FIGS. 6A and 6B are diagrams illustrating another layout example of the superconducting coils in the superconducting magnet apparatus shown in FIG. 5.
Figure 6B:
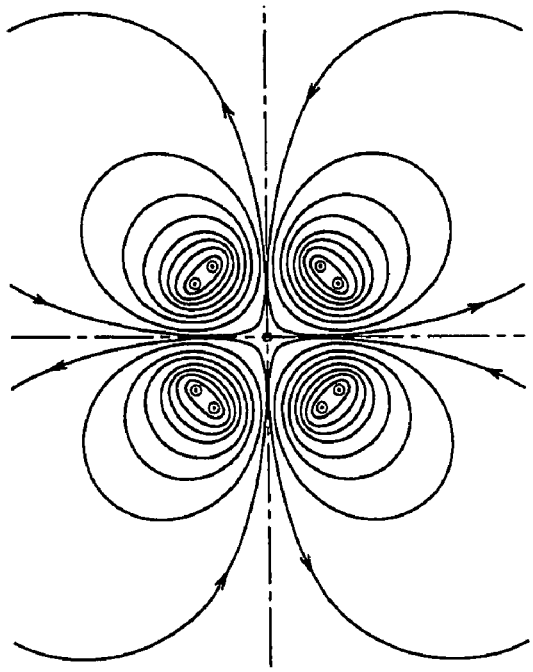
Figure 7:
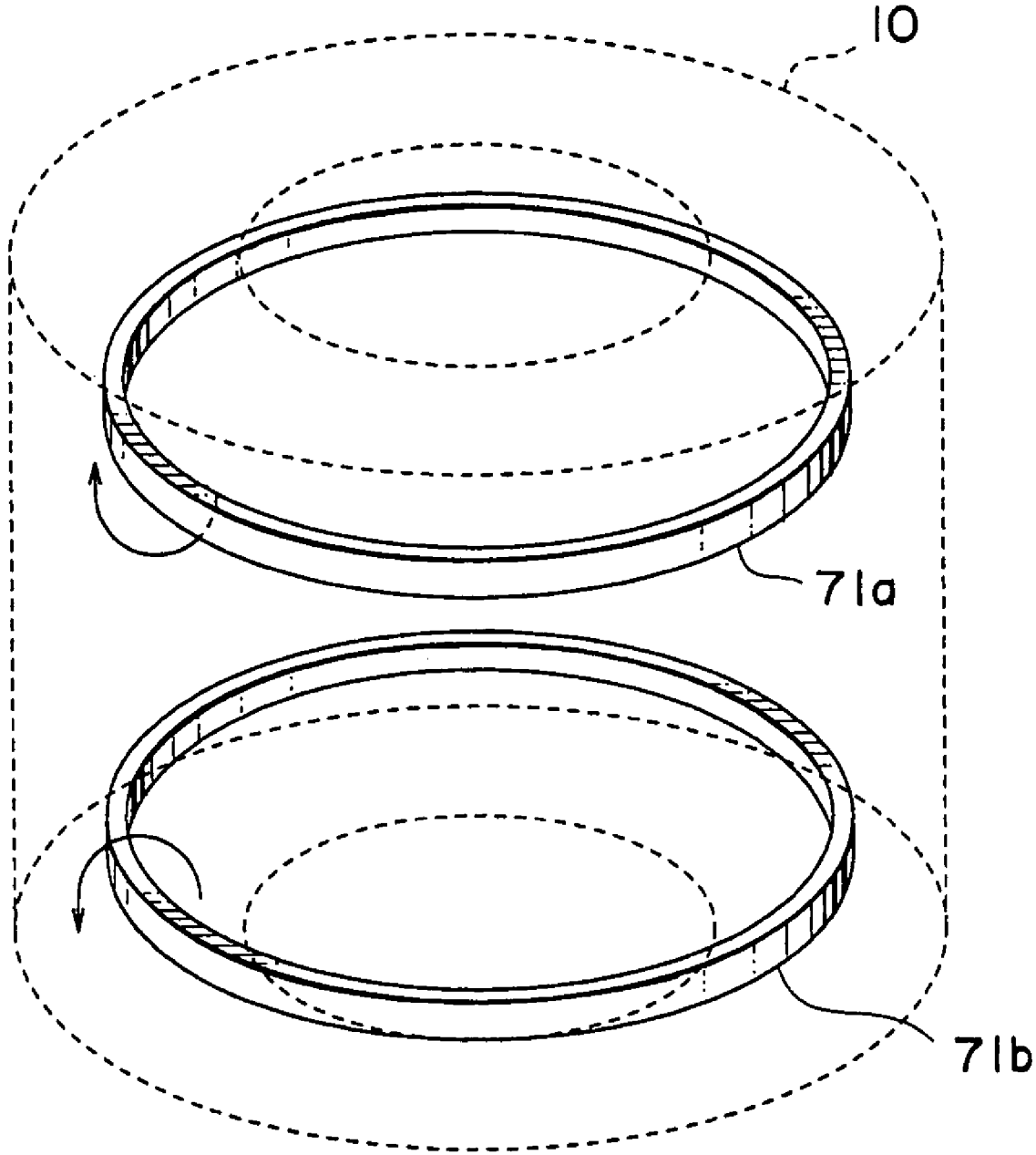
FIG. 7 is a diagram illustrating yet another layout example of the superconducting coils in the superconducting magnet apparatus shown in FIG. 5.

Referring now to FIGS. 6A, 6B, FIG. 7, and FIG. 8, a description will be given of other examples of coil layouts in the vacuum vessel that are different from the coil layout shown in FIG. 4B. FIGS. 6A and 7 show coil layouts for generating cusp magnetic fields. The coil layout shown in FIG. 6A and the coil layout shown in FIG. 7 are both intended for generating cusp magnetic fields, but different in the following aspects. Two superconducting coils 71*a* and 71*b* shown in FIG. 7 are disposed such that their central axes are vertically directed, that is, they are horizontally disposed at top and bottom. In the example illustrated in FIG. 6A, as it will be discussed hereinafter, the superconducting coils are vertically disposed, their central axes being horizontally oriented. In the example shown in FIG. 6A, the directions of the magnetic fields produced by adjoining coils are different so as to prevent the magnetic fields from crossing the center of the superconducting magnet apparatus. In the case of the example shown in FIG. 6A, an annular winding frame 13-3 shown in FIG. 5 will be formed for each superconducting coil on the outer periphery of the cylindrical coil cooling heat transfer member for supporting the superconducting coils, as in the case of the example illustrated in FIG. 4B.

In the example shown in FIG. 6A, two pairs of superconducting coils 11*a*, 11*b*, 21*a*, and 21*b* having the same specification are vertically disposed in the vacuum vessel 10 formed of a double-cylinder structure having a hollow space with its central axis oriented in a vertical direction. The two pairs of the superconducting coils 11*a*, 11*b*, 21*a*, and 21*b* are disposed such that the segments connecting the centers of the superconducting coils of the pairs are orthogonalized with each other at the center of the hollow space. Furthermore, the superconducting coils 11*a* and 11*b* of one pair oppose each other and the superconducting coils 21*a* and 21*b* of the other pair also oppose each other, sandwiching the hollow space of the vacuum vessel 10 therebetween. In addition, the superconducting coils 11*a*, 11*b*, 21*a*, and 21*b* of the two pairs are disposed such that they surround the central axis of the hollow space and that the symmetrical surfaces of the superconducting coils of each pair include the central axis. Currents are supplied to these superconducting coils such that adjacent superconducting coils produce magnetic fields in opposite directions from each other. This results in the distribution of cusp magnetic lines of four-fold symmetry with respect to the central axis of the hollow space, as shown in FIG. 6B.

In the case shown in FIG. 7, passing currents through the upper and lower superconducting coils 71*a* and 71*b* to generate magnetic fields in the opposite directions from each other forms a magnetic field called a vertical cusp.

Figure 8:
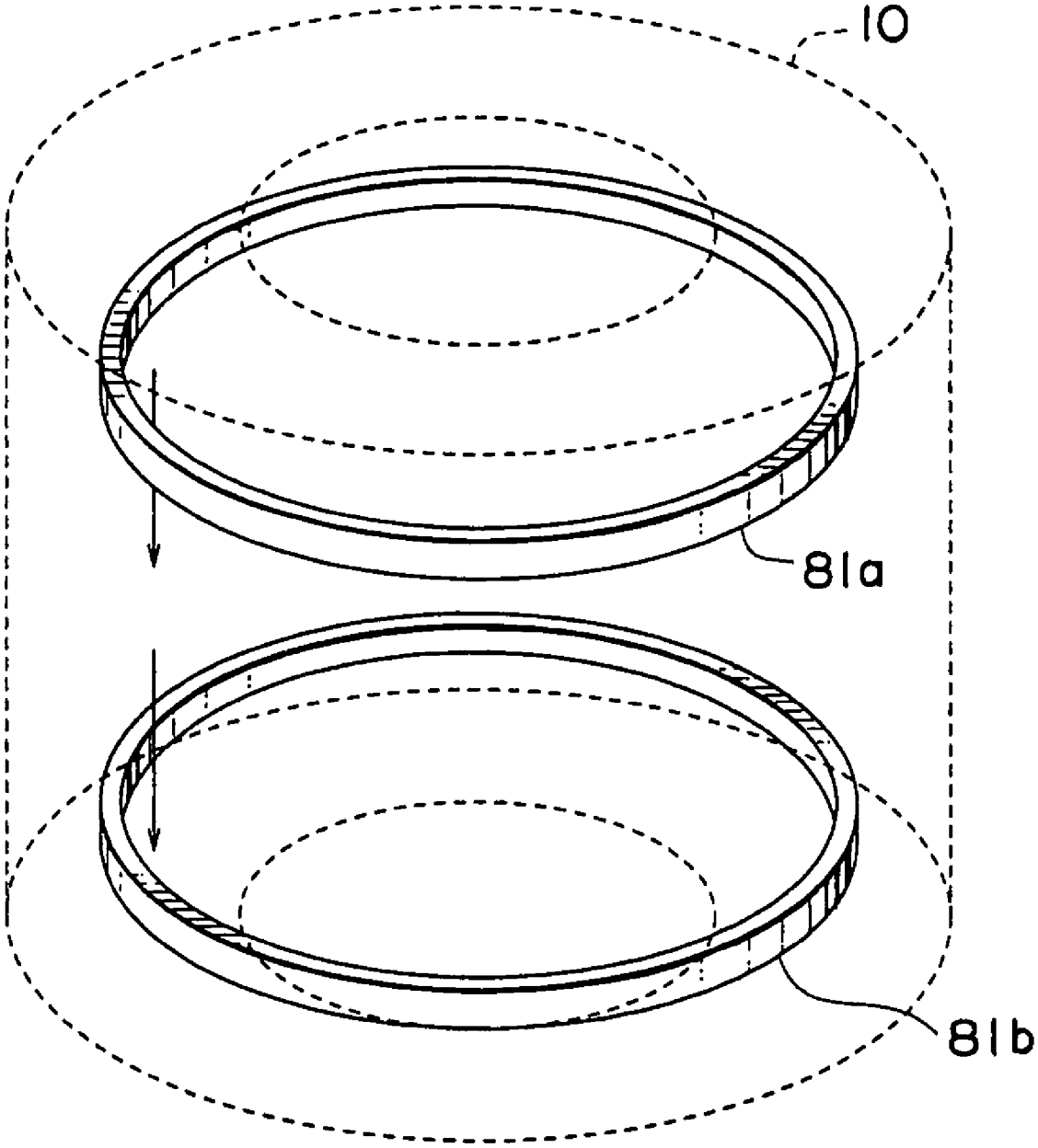
FIG. 8 is a diagram illustrating a further layout example of the superconducting coils in the superconducting magnet apparatus shown in FIG. 5.

In the example shown in FIG. 8, two superconducting coils 81*a* and 81*b* are horizontally disposed at top and bottom, as in the example shown in FIG. 7, but they produce magnetic fields in a different form. More specifically, in the example shown in FIG. 8, currents are supplied to the superconducting coils 81*a* and 81*b* in the same direction so as to generate parallel magnetic fluxes from the upper superconducting coil 81*a* toward the lower superconducting coil 81*b* or in the opposite direction thereof. In either case, the winding frames of the superconducting coils shown in FIG. 7 and FIG. 8 will be formed in annular shapes having larger diameters than the diameter of the inner cylinder of the vacuum vessel 10.

Referring back to FIG. 5, the single crystal pulling device is disposed in the hollow space of the superconducting magnet apparatus, that is, in the hollow space of the vacuum vessel 10. In the single crystal pulling device, a seed crystal (not shown) attached to a seed crystal holder 57 at the bottom end of a wire 56 or a pulling shaft is immersed in fused silicon 53 in the crucible 52 placed in a pulling furnace A. Thus, a single crystal is formed on the seed crystal by spontaneous coagulation. Then, the wire 56 is pulled up while turning it to grow a single crystal 54. A single crystal material in the crucible 52 is fused by the heat from a heater 51 provided around the crucible 52. A heat shielding member 55 for thermal insulation is provided around the heater 51. An opening 55*a* is formed in the upper center of the heat shielding member 55 so as not to interfere with pulling up single crystals.

To carry out maintenance of the GM refrigerator R, the motor drive M and displacers are drawn out, leaving the first and second-stage cooling cylinders C1 and C2, and then a new motor drive and displacers are installed.

The replacement operation will be explained, referring also to FIGS. 9A and 9B through FIGS. 13A and 13B.

Figure 9A:
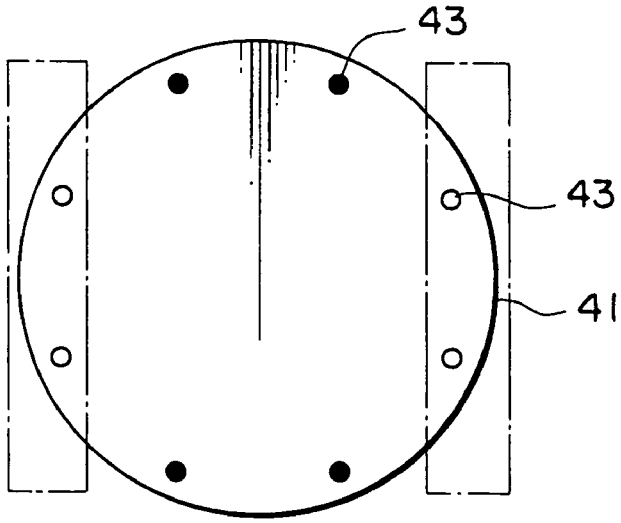

FIG. 9A shows the layout of a plurality of bolts 43 (eight bolts in this example) fastening the flange 21 and the flange 41 together.

Figure 9B:
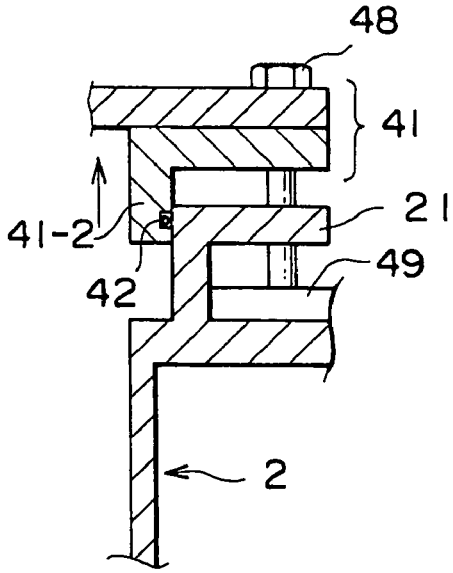
Figure 10:
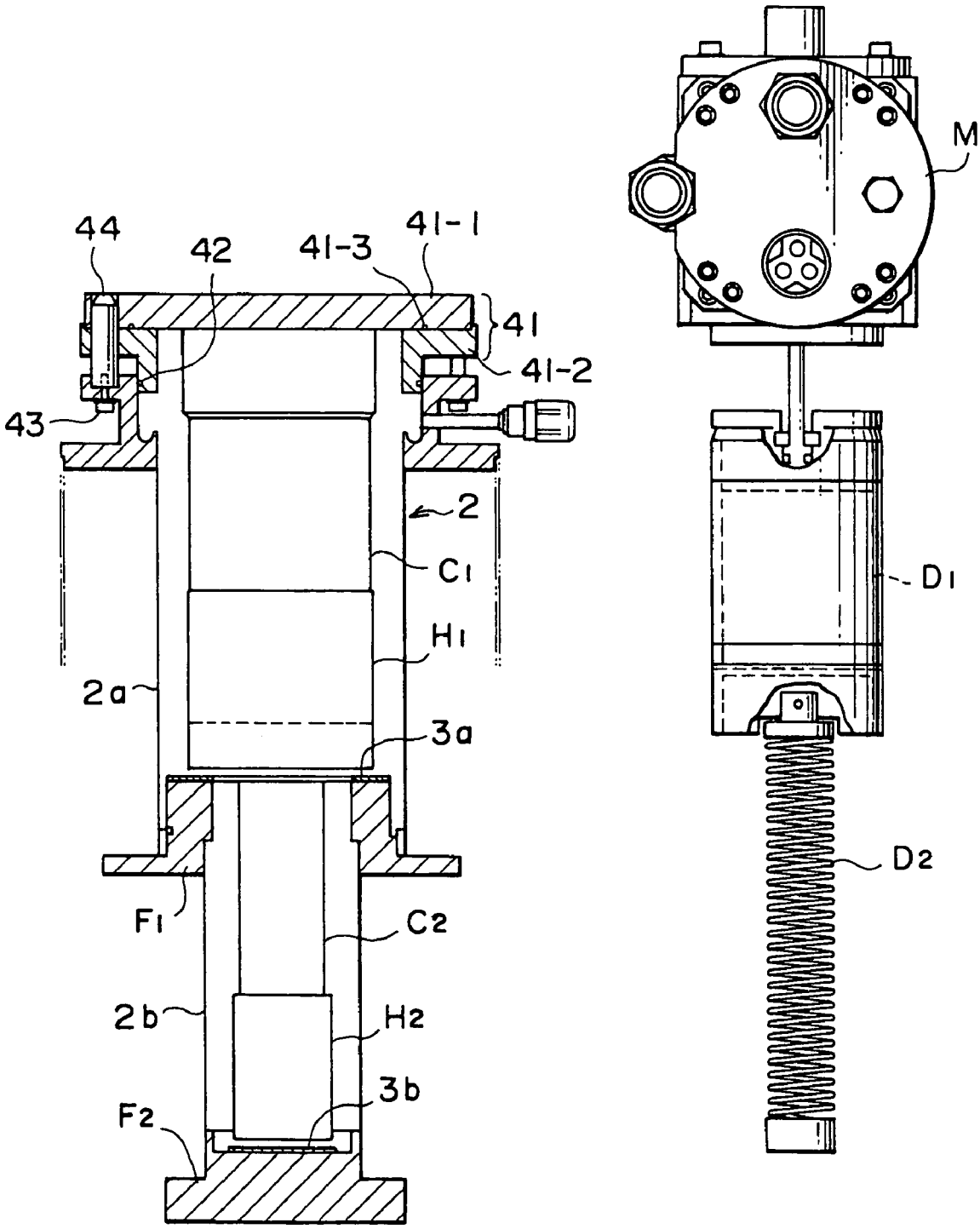
FIG. 10 shows a state wherein a motor drive and a displacer have been removed from the GM refrigerator shown in FIG. 5 to replace them.

Before starting the replacement operation, the GM refrigerator R is stopped. The bolts 43 are then sufficiently loosened. Of the eight bolts 43, the four bolts 43 located at positions symmetrical with respect to the center of the flange 41 are removed. In FIG. 9A, the bolts 43 to be left are shown by black dots, while the bolts 43 to be removed are shown by white circles. Different bolts 48 (second bolts) are screwed, from the flange 41 side, in the four locations from which the bolts 43 have been removed, as shown in FIG. 9B. At this time, a stopper 49 for receiving the distal ends of the bolts 48 is provided on the flange 21. As the bolts 48 are screwed in, the flange 41 moves away from the flange 21, that is, moves upwards. This causes a cylindrical portion 41-2 to also move upwards. Thus, the entire GM refrigerator R is pushed upwards, whereas the cylindrical portion 41-2 of the flange 41 is not fully pulled out of the sleeve 2. More specifically, the entire GM refrigerator R is pushed upwards to an extent where sealing by the O-ring 42 is maintained so as to protect the interior of the sleeve 2 from exposure to the air. The pushing up amount is a few millimeters, e.g., about 2 mm to about 3 mm. Thus, the first and second-stage cooling cylinders C1 and C2 of the GM refrigerator R are set apart from the sleeve 2, as shown in FIG. 10. This means that the first and second-stage cold heads H1 and H2 and the sleeve 2 lose their surface contact, and heat is no longer transferred through the thermal contact interfaces. Upon completion of the above operation, the bolts 48 and the stopper 49 are removed.

The operation described above may alternatively be performed as described below. Bolts (second bolts) similar to the bolts 48 may be screwed in from the lower surface side of the flange 21 at the positions among the bolts 43 such that the distal ends of the second bolts abut against the lower surface of the flange 41. Screwing the second bolts pushes the flange 41 upwards. After finishing the operation, the second bolts are of course removed.

Subsequently, in a cryogenic state, the displacers are drawn out together with the motor drive M, while leaving the first and second-stage cooling cylinders C1 and C2 of the GM refrigerator M as they are in the fixed state, and then new displacers are installed together with the new motor drive.

FIG. 10 illustrates the motor drive M that has been drawn out together with displacers D1 and D2, clearing the surface contact between the sleeve 2 and the first and second-stage cooling cylinders C1 and C2. Strictly speaking, FIG. 10 illustrates a state wherein the surface contact between the first-stage sleeve 2*a* and the first-stage cold head H1 have been cleared, and the surface contact between the second-stage sleeve 2*b* and the second-stage cold head H2 have been cleared.

Figure 11:
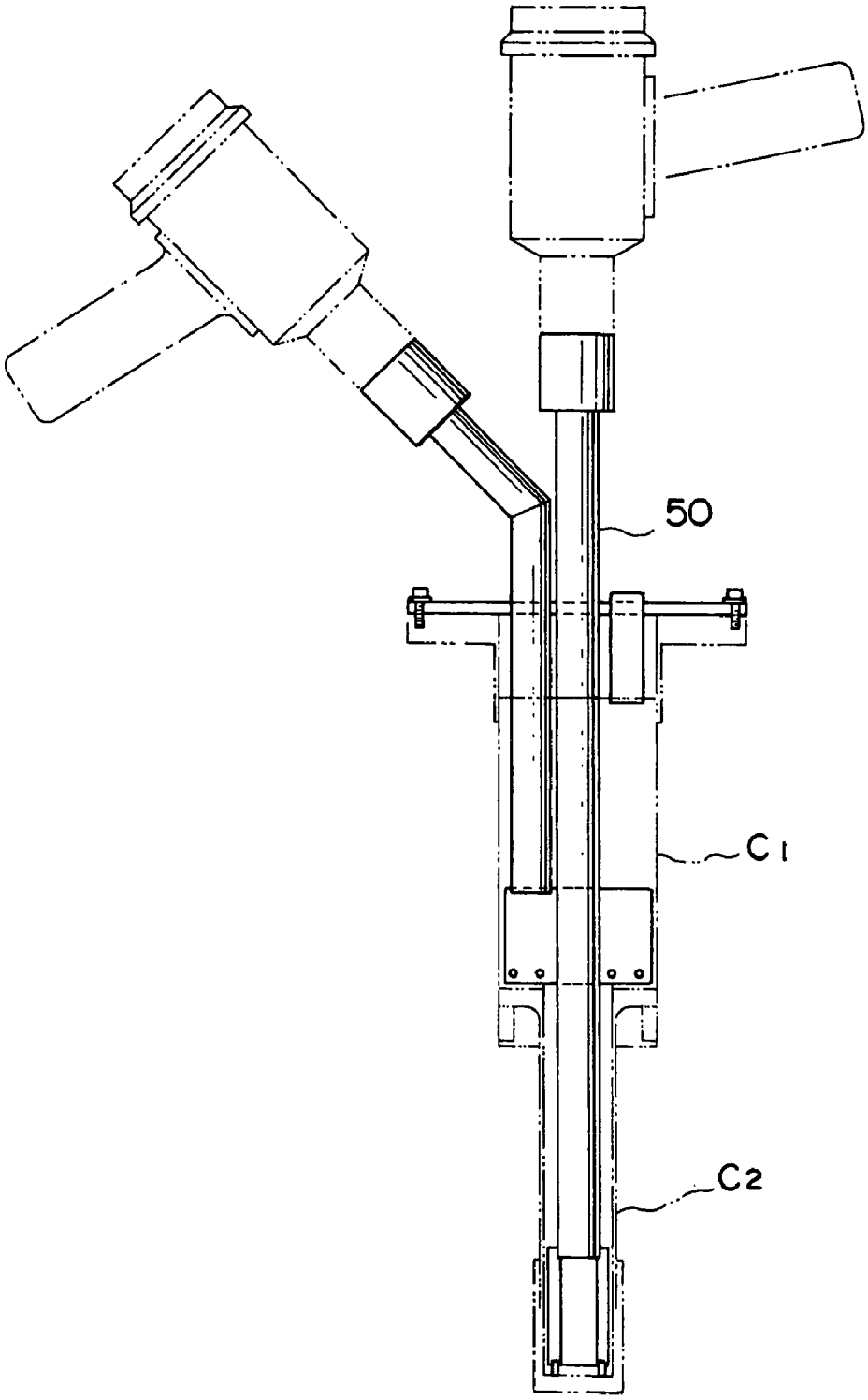
FIG. 11 is a diagram for explaining an operation for removing a frozen film or frost from the cooling cylinder after the motor drive and the displacer shown in FIG. 10 are taken out.

In the state illustrated in FIG. 10, the cryogenic inner surfaces of the empty first and second-stage cooling cylinders C1 and C2 exposed to the air are covered with frozen films and frost. Hence, the following operation is performed before the new motor drive and displacers are installed in the first and second-stage cooling cylinders C1 and C2. As shown in FIG. 11, a heating device, such as a dryer, 50 is inserted in the first and second-stage cooling cylinders C1 and C2, to heat the interior thereof so as to remove and clean off the frozen films or frost. The interior may be heated up to about 20° C. to about 40° C. The heating is carried out also to soften the indium sheets 3*a* and 3*b* attached to the bottom end surfaces of the first and second-stage cold heads H1 and H2.

In either case, the vacuum space sealed by the O-ring 42 exists between the sleeve 2 and the first and second-stage cooling cylinders C1 and C2 to block surface contact between the sleeve 2 and the first and second-stage cooling cylinders C1 and C2. This prevents the first and second-stage cooling cylinders C1 and C2 from being directly cooled due to a low temperature in the vacuum vessel 10. It is also possible to prevent heat from reaching the vacuum vessel 10 through the first and second-stage cooling cylinders C1 and C2 exposed to the air. This allows a temperature rise in the vacuum vessel 10 to be minimized.

Figure 12:
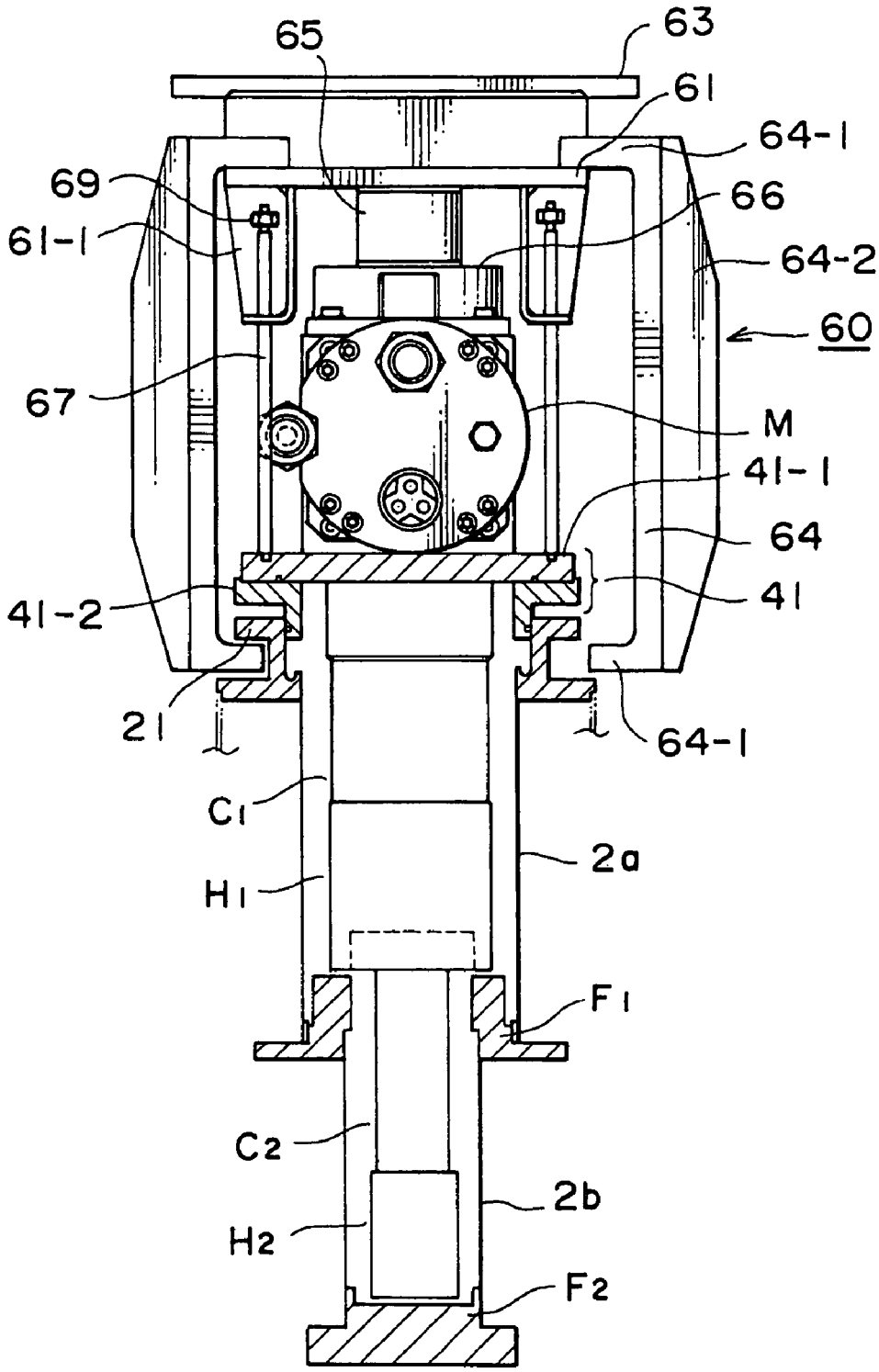
FIG. 12 is a diagram for explaining an operation for installing a new motor drive and displacer after the operation for removing the frozen film and frost illustrated in FIG. 11 is performed.

Before installing the new motor drive and displacers, the flange 41, which has been pushed upwards, is set back to its original position. The flange 41 is pushed down to bring the sleeve 2 back into surface contact with the first and second-stage cooling cylinders C1 and C2. The flange 41 is pushed down using a booster 60 hydraulically or mechanically generating a pushing force, as shown in FIG. 12. The entire GM refrigerator R is pushed down by the booster 60. At this time, the inclination of the first and second-stage cooling cylinders C1 and C2 caused by the displacers is restrained by the guide pins 44, and the first and second-stage cooling cylinders C1 and C2 are substantially reset to their original positions. In addition, the indium sheets 3*a* and 3*b* are softened, permitting flexible surface contact to be accomplished even if a small inclination still remains.

The operation described above enables the first and second-stage cold heads H1 and H2 to secure as good heat transmitting performance as that before the replacement.

Referring now to FIG. 12, a detailed description will be given of a method for inserting a motor drive and displacers finished with replacement of worn parts or the like or a new motor drive and displacers into the first and second-stage cooling cylinders C1 and C2. The first and second-stage cooling cylinders C1 and C2 are apart from the sleeve 2, vacuum being present between the first and second-stage cooling cylinders C1 and C2 and the sleeve 2. The superconducting coils, however, still remain cryogenic, so that the first and second-stage cooling cylinders C1 and C2 have been cooled to a certain degree. This means that exposing the first and second-stage cooling cylinders C1 and C2 to the air would lead to dew condensation, and also means that the diameters of the first and second-stage cooling cylinders C1 and C2 have been reduced due to the cooling. It is, therefore, difficult to insert the displacers into the first and second-stage cooling cylinders C1 and C2 with the reduced diameters. For these reasons, a heating device, such as a dryer, is used to raise the temperature of the first and second-stage cooling cylinders C1 and C2 to about normal temperature (room temperature).

Next, the displacers are inserted in the first and second-stage cooling cylinders C1 and C2, and the flanges 21 and 41 are loosely fastened by the bolts 43, leaving some fastening allowance between the flange 21 and the flange 41. Then, using the booster 60, a force for pushing the entire GM refrigerator R down is promptly applied. This brings end portions of the first and second-stage cold heads H1 and H2 into contact with the first and second-stage cooling flanges F1 and F2, respectively, of the sleeve 2. Thereafter, the booster 60 is removed, and the flanges 21 and 41 are sufficiently tightened by the bolts 43 so as not to leave any fastening allowance left therebetween. This fully secures the GM refrigerator R to the vacuum vessel 10.

Figure 13A:
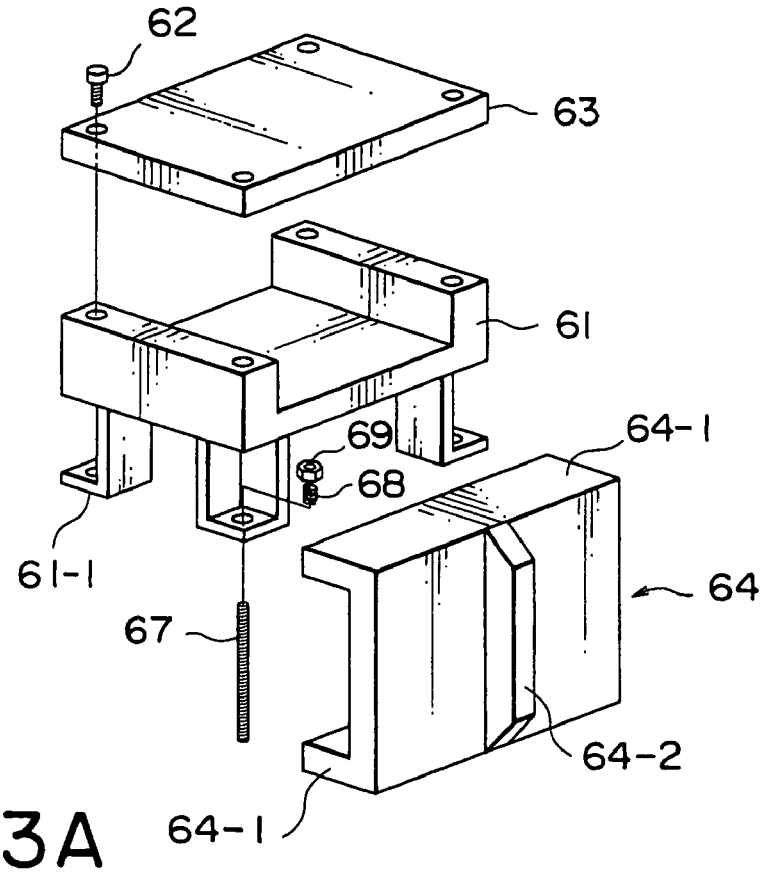
Figure 13B:
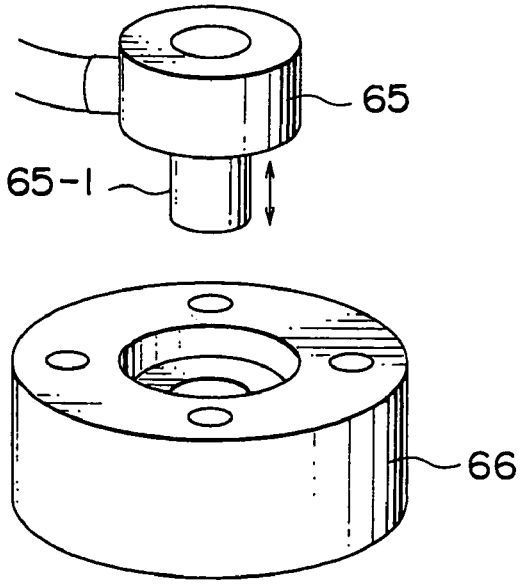

The booster 60 has a base plate 61, a reinforcing plate 63 and two fastening plates 64 (only one being shown) shown in FIG. 13A, and a hydraulic jack 65 and a jig 66 shown in FIG. 13B. The base plate 61 has plate members, which project upwards, on both of its sides. The four corners on the bottom of the base plate 61 have legs 61-1. The reinforcing plate 63 is secured by a plurality of bolts 62 to the upper ends of the plate members on both sides of the base plate 61. The fastening plate 64 has hooks 64-1 on its upper and lower ends and also has a reinforcing rib 64-2 that vertically extends. The jig 66 is disposed between the hydraulic jack 65 and the head of the motor drive M.

In FIG. 13A, threaded rods 67, coil springs 68, and nuts 69 are used when the GM refrigerator R is inserted from under the vacuum vessel 10. In other words, the base plate 61, the fastening plates 64, the hydraulic jack 65, etc. are not mechanically integrated. Accordingly, to insert the GM refrigerator R from under the vacuum vessel 10, the base plate 61 is suspended from the flange 41 by the threaded rods 67 and maintained in the suspended state. For this purpose, the upper surface of the flange 41 has tapped holes for the threaded rods 67 to be screwed in to a predetermined depth. The four corners on the bottom of the base plate 61 have the legs 61-1 in which the threaded rods 67 can be inserted. This allows the base plate 61 to be suspended from the flange 41 by the threaded rods 67 and the nuts 69.

Each fastening plate 64 is formed of a thick steel plate having the hooks 64-1 on its upper and lower ends, the hooks being bent at right angles. The two fastening plates 64 are installed so as to be laterally symmetrical. The lower hooks 64-1 of the fastening plates 64 hook onto the side adjacent to the vacuum vessel 10, that is, the lower side of the flange 21. FIG. 9A shows the positions of the lower hooks 64-1 of the fastening plates 64 by chain lines. This shows that the lower hooks 64-1 are positioned in the areas from which the bolts 43 have been removed. The upper hooks 64-1 of the fastening plates 64 hook onto the upper end of the base plate 61.

The hydraulic jack 65 is disposed between the bottom surface of the base plate 61 and the head of the motor drive M in the GM refrigerator R. As shown in FIG. 3, the head of the motor drive M in the GM refrigerator R usually has a projection M1 and a plurality of bolt heads M2, so that the jig 66 is used to stabilize the hydraulic jack 65. The jig 66 has a recessed portion in its bottom surface to accommodate the above projection M1 and the plurality of bolt heads M2 and also has another recessed portion in its top surface to accommodate an extension portion 65-1 of the hydraulic jack 65. Thus, the hydraulic jack 65 can be set between the jig 66 and the base plate 61 without being affected by the projection on the top of the motor drive M.

The hydraulic jack 65 is columnar, and the extension portion 65-1 located at its center extends when pressure oil is received through a hydraulic pipe (not shown). When the extension portion 65-1 extends, the base plate 61 attempts to move upwards. The base plate 61 is, however, restricted by the upper hooks 64-1 of the fastening plates 64, so that a force is applied to the motor drive M to push it downwards. As a result, the GM refrigerator R is pushed down, as a whole. More specifically, when the base plate 61 attempts to move upwards, the lower hooks 64-1 hook on the lower side of the flange 21 and the upper hooks 64-1 hook on the upper side of the base plate 61, thus preventing the base plate 61 from moving upwards. This guides the displacers and the first and second-stage cooling cylinders C1 and C2 to be accurately inserted together with the flange 41 into the sleeve 2 in the vacuum vessel 10 along the guide pins 44 shown in FIG. 3.

After the entire GM refrigerator R has been pushed down, the booster 60 is removed. Then, the bolts 43, which had been removed, are reinstalled and fully tightened together with the remaining bolts 43.

The booster is a device that uses a mechanism, such as a screw pantographic jack, to convert a weak force, such as a human force, into a large, quick extending force. This type of boosters includes those utilizing pneumatic pressure or electromagnetic force, or a converting mechanism combining a motor and a ball screw, in addition to the hydraulic jack.

The present invention is expected to provide the advantages described below. When the replacement operation of the refrigerator is begun, the temperature of the main bodies of superconducting coils in a superconducting magnet apparatus attempts to rise. However, when the operation is performed, the displacers and the top portion of the refrigerator are drawn out, leaving the cooling cylinders, so that the space formed between the sleeve and the cooling cylinders is vacuum. As a result, invading heat from the surrounding area is minimized so that the temperature of the main bodies of the superconducting coils slowly rises. In addition, the replacement operation can be finished at the point when the temperature rises to about 15K from 4K, requiring a smaller number of days to cool the superconducting coils back to 4K. The entire operation can be completed in two or three days. Accordingly, the present invention makes it possible to achieve an extremely shorter shutdown of a single crystal pulling device.

Temperature changes in the superconducting coils range from 4K to 300K according to a conventional method in which the operation of a superconducting magnet apparatus is interrupted. Such temperature changes are smaller, ranging from 4K to 15K according to the present invention, thus minimizing damage to superconducting coils themselves or the entire superconducting magnet apparatus caused by thermal stress cycles.

Furthermore, superconducting coils maintained to be cool and energized generate strong magnetic fields, applying considerable stress to coil winding frames or the like. This leads to a failure in which changes in stress causes a training phenomenon, resulting in repetition of so-called quenching rather than superconduction in conventional methods. The present invention permits such a phenomenon to be restrained.

The guide pins provided according to the present invention are advantageous in the following aspects.

When a refrigerator was actually installed without using the guide pins, the following problem was observed. Guidance by slidably moving an O-ring (sealing ring) damages its sliding surface because of the presence of a crushing allowance of the O-ring when displacers and the upper portion of a refrigerator are inserted aslant, making the insertion extremely difficult. A great deal of time has been spent to identify the causes for the above problem, and the present invention has solved the problem by adding the guide pins.

In addition, a booster, such as a hydraulic jack, is extremely useful for shortening the time required for a replacement operation. More specifically, to install displacers and the top portion of a refrigerator, the temperature of cooling cylinders must be raised to normal temperature and the displacers must be quickly inserted. Otherwise, only the cooling cylinders are cooled again and contract with resultant reduced diameters. This may cause a problem in which the displacers still having a high temperature fail to resume their cooling operation. Furthermore, indium sheets mounted on thermal contact interfaces do not generate a repulsive force if they are slowly pressed with a weak force, causing deteriorated heat transmission thereafter. This results in a problem in that the coils are not sufficiently cooled. Thus, it has been found impractical to push the entire refrigerator down simply by fastening with the bolts, as explained in conjunction with FIG. 2.

In the above description, a GM refrigerator has been used as an embodiment according to the present invention. Obviously, however, the present invention can be applied to other types of refrigerators.

What is claimed is:

1. A superconducting magnet apparatus comprising:

a vacuum vessel;

a superconducting coil accommodated in the vacuum vessel; and one or more refrigerators attached to the vacuum vessel to cool the superconducting coil, wherein the refrigerator comprises:

a motor drive;

a displacer attached to the motor drive and driven by the motor drive; and a cooling cylinder accommodating the displacer so as to allow the displacer to reciprocate, the vacuum vessel being formed of a double-cylindrical structure having a hollow space in its center, a sleeve being provided in the vacuum vessel to accommodate the cooling cylinder by isolating it from a vacuum area in the vacuum vessel, and the sleeve having an opening near the wall of the vacuum vessel, the cooling cylinder being partly in surface contact with the sleeve, an opening portion of the cooling cylinder through which the displacer is inserted having a first flange to which the motor drive is installed with the displacer inserted therein and also having a cylindrical portion inserted into the sleeve to seal the space in the sleeve, and a sealing ring being provided between the cylindrical portion and an inner wall of the sleeve that opposes the cylindrical portion, the motor drive and the displacer being capable of removing from the vacuum vessel, leaving the first flange and the cooling cylinder.

2. The superconducting magnet apparatus according to claim 1, wherein the vacuum vessel is provided with at least two pairs of vertically disposed superconducting coils opposing each other with the hollow space therebetween, an angle formed by central axes of adjoining superconducting coils of adjoining pairs is set to 90 degrees or less, and a resultant generated magnetic flux forms a horizontal magnetic field passing through a vertical central axis in the hollow space.

3. The superconducting magnet apparatus according to claim 1, wherein the vacuum vessel is provided with at least two pairs of vertically disposed superconducting coils opposing each other with the hollow space therebetween, an angle formed by central axes of adjoining superconducting coils of adjoining pairs is set to 90 degrees, and a resultant generated magnetic flux forms a cusp magnetic field that does not pass through a vertical central axis in the hollow space.

4. The superconducting magnet apparatus according to claim 1, wherein the vacuum vessel is provided with horizontally disposed annular superconducting coils that surround the hollow space and are disposed at an upper side and a lower side to generate, using the upper and lower superconducting coils, a vertical magnetic field formed of a parallel magnetic field directed from top to bottom or a vertical magnetic field formed of a parallel magnetic field directed from bottom to top.

5. The superconducting magnet apparatus according to claim 1, wherein the vacuum vessel is provided with horizontally disposed annular superconducting coils that surround the hollow space and are disposed at an upper side and a lower side, and a magnetic flux generated by the upper and lower superconducting coils is reversed to produce a cusp magnetic field that does not pass through the vertical central axis in the hollow space.

6. The superconducting magnet apparatus according to claim 1, wherein a second flange opposing the first flange is integrally provided with the vacuum vessel in the vicinity of the opening of the sleeve such that the second flange slightly juts out of the vacuum vessel, the first flange and the second flange are fastened together with a plurality of first bolts, and at least one guide pin for restricting the tilt of the cooling cylinder caused by the displacer when the cylindrical portion is inserted in the sleeve is provided between the first flange and the second flange.

7. The superconducting magnet apparatus according to claim 6, wherein the plurality of first bolts is inserted from the second flange to the first flange such that it passes through the second flange in a loosely fitted manner, and a spring washer is placed between heads of the first bolts and the second flange against which the heads face.

8. A superconducting magnet apparatus for a single crystal pulling device, comprising a single crystal pulling device in the hollow space of the vacuum vessel in the superconducting magnet apparatus according to claim 1.

9. A maintenance method of a refrigerator in the superconducting magnet apparatus according to claim 6, surface contact between a part of the cooling cylinder and the sleeve being effected on a plane perpendicular to a direction in which the cooling cylinder extends, and replacing the displacer comprising the steps of:

removing a predetermined number of the plurality of first bolts;

loosening the remaining first bolts;

screwing second bolts from the first flange side into the holes, from which the first bolts have been removed, to detach the first flange from the second flange so as to draw out the cylindrical portion by a few millimeters, thereby clearing the surface contact while maintaining the sealing between the sleeve and the cooling cylinder;

removing the second bolts and the motor drive from the first flange to draw out the displacer from the cooling cylinder;

increasing the temperature in the cooling cylinder;

inserting a new assembly of the motor drive and the displacer into the cooling cylinder through the first flange;

applying a pressing force by a booster to a head of the motor drive to push the cylindrical portion back to its original position so as to bring a portion of the cooling cylinder and the sleeve back into surface contact; and tightening the first bolts.

10. The maintenance method of a refrigerator in the superconducting magnet apparatus according to claim 9, wherein the booster comprises a base plate to be disposed adjacently to the head of the motor drive, an extending force generating mechanism to be disposed between the base plate and the head of the motor drive, and at least two fastening plates having upper and lower hooks to be hooked on the base plate and the second flange, respectively, and a pressing force is applied to the head of the motor drive by generating a force to pull the base plate and the head of the motor drive apart from each other by the extending force generating mechanism, while restraining the base plate from moving upwards by the fastening plates.

* * * * *